United States Patent [19]

Waldenström

[11] Patent Number: 4,584,020

[45] Date of Patent: Apr. 22, 1986

[54] WEAR PART WITH HIGH WEAR STRENGTH

[75] Inventor: Mats G. Waldenström, Sundbyberg, Sweden

[73] Assignee: Santrade Limited, Lucerne, Switzerland

[21] Appl. No.: 557,936

[22] Filed: Dec. 5, 1983

[30] Foreign Application Priority Data

Dec. 6, 1982 [SE] Sweden ..... 8206950

[51] Int. Cl.[4] ..... C22C 29/02

[52] U.S. Cl. ..... 75/236; 75/123 CB; 75/130 R; 75/243; 428/548; 428/552; 428/565

[58] Field of Search ..... 75/236, 123 CB, 130 R, 75/243; 428/548, 552, 565

[56] References Cited

U.S. PATENT DOCUMENTS

| | | | |
|---|---|---|---|
| 4,066,451 | 1/1978 | Rudy | 75/241 |
| 4,101,318 | 7/1978 | Rudy | 75/241 |
| 4,119,459 | 10/1978 | Ekemar et al. | 75/243 |
| 4,177,324 | 12/1979 | Brown et al. | 75/241 |
| 4,312,894 | 1/1982 | Brown et al. | 75/239 |
| 4,443,255 | 4/1984 | Brown et al. | 75/241 |
| 4,446,196 | 5/1984 | Brown | 75/241 |

FOREIGN PATENT DOCUMENTS 102563 9/1941 Sweden .

*Primary Examiner*—Stephen J. Lechert, Jr.
*Attorney, Agent, or Firm*—Burns, Doane, Swecker & Mathis

[57] ABSTRACT

In wear parts consisting of sintered cemented carbide and cast alloy on iron base, in which a wear resistant layer of cast-in-carbide is formed in the most exposed parts of the product, the chipping of cemented carbide from the wear layer can be essentially eliminated according to the invention by applying a layer of another metallic material, for example steel, between the cast alloy and the wear layer.

14 Claims, 4 Drawing Figures

WEAR PART WITH HIGH WEAR STRENGTH

Figure 1A:
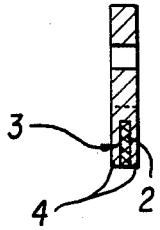

The present invention relates to wear parts with high wear strength combined with high toughness and fracture strength such as snow plough blades, road grader blades, ice blades (toothed road grader blades), excavator teeth, dredger teeth, steelcutters etc. produced by means of embedding of sintered cemented carbide in a cast alloy on iron base. Characteristic for such cast wear parts is that the part especially exposed to wear is provided with a or consists of a wear resistant wear layer of cast-in-carbide in the form of crushed parts, bodies or pieces of random shape.

For e.g. various types of blades the risk of chipping of the wear layer is great on the front and reverse sides of the blades whereas for excavator and dredger teeth the risk of chipping is considerable on all sides of the wear layer. According to the invention it has, however, turned out to be possible to reduce the chipping of the cemented carbide in the wear layer and to increase the resistance against crack propagation of the product by applying between the pure cast alloy and the wear layer consisting of cast-in-carbide a layer or zone of another metallic material with higher toughness than the cast alloy. Generally, the metallic material has also a higher melting point than the cast alloy. The thickness of this zone can vary from some 10 μm up to several centimeters but shall generally be at least 0.3 mm and preferably 1–8 mm. The zone need necessarily not be continuous but may in one or more places be broken through by material belonging to the cast alloy.

Characteristic for the invention is also that exposed parts of the wear layer of cast-in-carbide—as well as the zone of another metallic material—is protected by sufficiently thick outer layers of only cast alloy. These outer layers, which in the first place even more reduces the risk of chipping in the wear layer and even more strengthens the resistance against crack formation of the product can with advantage be applied in connection with the embedment of the sintered cemented carbide i.e. the production of the wear layer. The thickness of these outer layers shall be on the average of at least 1 mm and preferably on the average of 3 mm.

The cast alloy consists of in itself earlier known way—see e.g. Swedish Pat. No. 399 191—preferably an essentially graphitic cast iron with in itself low wear strength and a composition adjusted so that the carbon equivalent, $C_{eg}$, i.e. the carbon content besides the contents of the other constituents and alloying elements equivalent to carbon, is with respect to the influence on the properties of the cast iron at the lowest 3.5 and at the most 6.0. An intermediate alloying phase or transition zone is, as a rule, developed between the cemented carbide and the cast alloy, generally 10–90% and preferably 20–80% of the added amount of cemented carbide being included in the transition zone. When using crushed pieces at least 90% of the added amount of cemented carbide shall have a size from 1 to 8 mm. In addition, the surface fraction of the cemented carbide in the wear layer shall be at least 20%, preferably 40–70% and also the thickness of the wear layer shall be such that the surface fraction of the cemented carbide grains in the wear layer projected down on the surface of the wear layer shall be at least 50%, preferably 100%.

The wear part according to the invention can be produced by modifying earlier known technique—see e.g. Swedish Pat. No. 102 563. The product can consequently be produced by placing the cemented carbide on top of one or more adequately designed sheets, which have been located in the mould in the intended place before casting in such a way that the cast alloy can pass at least on the upper and lower sides. The sheet material should be chosen such that its melting point is at least 50° C., preferably at least 200°–400° C. above the melting point of the cast alloy in question. When casting with a cast iron such as e.g. an essentially graphitic cast iron a low carbon steel has turned out to be a suitable sheet material. Generally, the carbon content of the steel is 0.2% at the most. When casting with more high melting cast alloys more refractory sheet material such as e.g. tungsten or molybdenum can be a possible choice.

The sheet material shall be made so thin that its cooling effect does not prevent that a good metallurgical bond cemented carbide—cast alloy—sheet material is obtained. On the other hand the thickness of the sheet shall be so great that the sheet remains essentially intact in the finished cast part. This means, however, that the thickness can vary within comparatively wide limits. These are determined chiefly by the size and shape of the cast part and of the extension and place of the wear layer in the part. In addition, the limits depend on the melting point of the cast alloy and also of the ability of the sheet material to stop crack propagation in the cast alloy. Generally, the thickness should be at least 0.5 mm and preferably 1–8 mm.

Figure 1B:
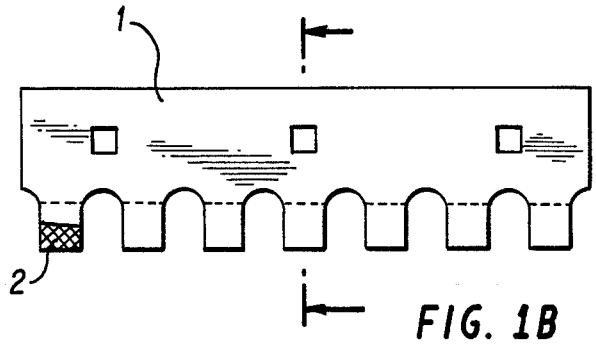
Figure 2A:
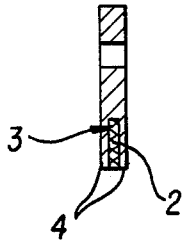
Figure 2B:
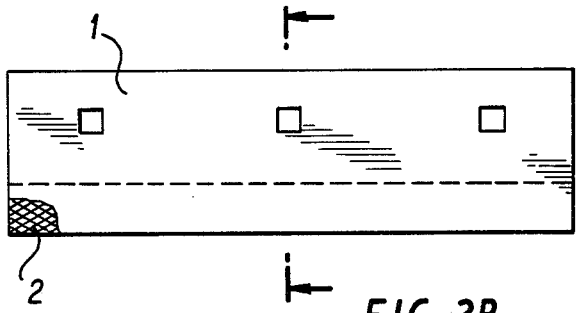
Figure 3:
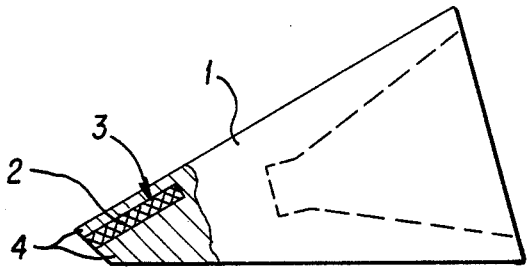
Figure 4:
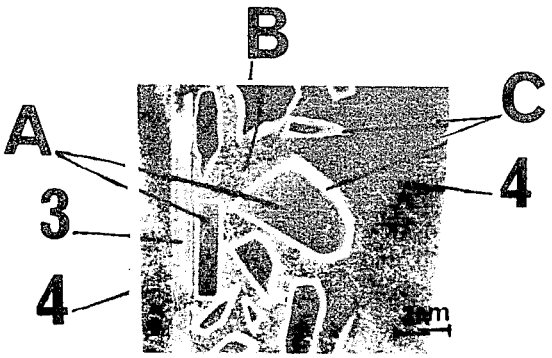

FIG. 1 shows the principle of the invention exemplified by an ice blade. The blade is composed of on one hand a main part comprising a cast alloy 1, on the other hand a wear layer 2 comprising cast-in-carbide. According to the invention a layer 3 of another metallic material, preferably steel, has been applied between the outer protective layer 4 (sometimes only on one side) and the wear layer. The corresponding principle for other possible types of blades according to the invention, snow plough blade and road grader blade resp., is shown in FIG. 2 whereas FIG. 3 shows the principle for an excavator or dredger tooth. All the designations correspond with the description according to FIG. 1.

The structure image in FIG., 4 shows a cross section through a part of an ice blade tooth, where the wear layer, which comprises cemented carbide grains (A) embedded in cast alloy (B) on one side is protected by a zone of another metallic material 3 and also on both sides of the protecting layers 4 consisting of only cast alloy. Between the cemented carbide grains (A) and the cast alloy (B) an alloying or diffusion zone (C) is present.

According to the invention it now exists a body composed of cemented carbide and cast alloy with a completely unique wear strength combined with high toughness as well as fracture strength. The metal zone characteristic of the invention and also the protective layers surrounding the wear layer result in that the risk of chipping of the cemented carbide in the wear layer becomes exceedingly small and also that the resistance to crack propagation in the product increases, which in its turn results in an effective use of the extremely high wear strength of the cemented carbide and also a considerably enhanced fracture strength of the finished cast part.

According to the invention it has been possible to produce wear parts for road maintenance comprising cemented carbide and graphitic cast iron according to the manufacturing example below.

Crushed cemented carbide (grade: WC - 6 weight-% Co) with a fraction area of 1–5 mm was located with metal sheet boxes of a low carbon steel in the mould of an ice blade (length: 1220 mm) before casting. Casting was done at 1370° C. and a nodular graphitic cast iron was used as cast alloy. During earlier performed testing with ice blades made without the metal zone especially characteristic of the invention and the protective layers, i.e. the wear layer was situated in the surface of the teeth, there was obtained a wear strength 7–8 times higher than what is obtainable with conventional ice blades in steel. When inspecting these blades it was observed that the chipping of cemented carbide in the wear layer had been considerable. On some occasions a number of teeth had, in addition, been broken due to the high stresses.

When testing an ice blade according to the invention under comparable conditions a wear strength 14–15 times higher than for conventional ice blades in steel was obtained and only a slight chipping of the cemented carbide in the wear layer could be observed at the same time as the enhanced fracture strength resulted in that no tooth failures occurred.

I claim:

1. Wear part with high wear strength combined with high mechanical strength and toughness, comprising a base portion comprising an iron-base alloy, a wear-resistant portion comprising cemented carbide particulates embedded in said iron-base alloy and an intermediate portion being at least 0.3 mm thick between at least a part of the wear-resistant portion and the base portion of a metal or metal alloy having a toughness greater than that of the iron-base alloy of the base portion.

2. Wear part according to claim 1 wherein the cast alloy is made up of a cast iron.

3. Wear part according to claim 1 wherein the metallic material is a steel.

4. Wear part according to claim 1 wherein the melting point of the metallic material is at least 50° C.

5. Wear part according to claim 2, wherein the metallic material is a steel.

6. Wear part according to claim 2, wherein the melting point of the metallic material is at least 50° C.

7. Wear part according to claim 3, wherein the melting point of the metallic material is at least 50° C.

8. Wear part according to claim 2, wherein the cast iron alloy is an essentially graphitic cast iron.

9. Wear part according to claim 4, wherein the melting point of the metallic material is 200°–400° C. above that of the cast alloy.

10. Wear part according to claim 5, wherein the melting point of the metallic material is 200°–400° C. above that of the cast alloy.

11. Wear part according to claim 6, wherein the melting point of the metallic material is 200°–400° C. above that of the cast alloy.

12. Wear part according to claim 7, wherein the melting point of the metallic material is 200°–400° C. above that of the cast alloy.

13. Wear part according to claim 1, wherein the said intermediate portion if from 1–8 mm thick.

14. Wear part according to claim 13, wherein the thickness of the base portion in which the wear-resistant portion is embedded is at least 1 mm.

* * * * *